United States Patent [19]

Engel et al.

[11] Patent Number: 4,860,426

[45] Date of Patent: Aug. 29, 1989

[54] SYSTEM FOR ROLLING CONTINUOUSLY CAST PROFILES

[75] Inventors: Georg Engel, Kaarst; Dietmar Kosak, Neuss, both of Fed. Rep. of Germany

[73] Assignee: SMS Schloemann-Siemag Aktiengesellschaft, Dusseldorf, Fed. Rep. of Germany

[21] Appl. No.: 114,344

[22] Filed: Oct. 27, 1987

[30] Foreign Application Priority Data

Oct. 27, 1986 [DE] Fed. Rep. of Germany ..... 3636478

[51] Int. Cl.[4] ..... B21B 1/46; B21B 1/14; B21B 13/10; B21B 13/22

[52] U.S. Cl. ..... 29/527.7; 72/225; 72/229; 72/234

[58] Field of Search ..... 29/527.7; 72/225, 229, 72/234, 235, 366

[56] References Cited

U.S. PATENT DOCUMENTS

| | | | |
|---|---|---|---|
| 1,076,784 | 10/1913 | Puppe | 72/235 X |
| 1,812,247 | 6/1931 | Oberg et al. | 72/235 X |
| 3,243,983 | 4/1966 | Nordlindh et al. | 72/235 |
| 3,657,912 | 4/1972 | Ishibashi et al. | 72/234 |
| 4,086,801 | 5/1978 | Nakajima et al. | 72/234 |
| 4,294,099 | 10/1981 | Spaude | 72/234 |
| 4,301,670 | 11/1981 | Engel et al. | 72/234 X |
| 4,381,658 | 5/1983 | Kugushin et al. | 72/234 |

*Primary Examiner*—E. Michael Combs
*Attorney, Agent, or Firm*—Herbert Dubno

[57] ABSTRACT

A hot profile-steel workpiece having a flange width dimension, a web height dimension, and a web thickness dimension is rolled in a roll train including a reversible univerial rolling stand and a flange-compacting roll stand unstream therefrom. According to the invention one of the height, width, or thickness dimensions of the incoming workpiece is reduced upstream of the flange-engaging compacting roll stand. Normally the web height dimension is reduced in a roll stand immediately upstream of the universal and flange-compacting stands. Furthermore the workpiece has a web with extra-thick parts and these extra-thick parts are rolled out by horizontal rolls of a roll stand that engage this web. The flange-compacting roll stand engages the faces of the flanges. With this system it is possible to make the web of the incoming workpiece either shorter or taller, that is it can either be compacted or rolled out.

4 Claims, 1 Drawing Sheet

SYSTEM FOR ROLLING CONTINUOUSLY CAST PROFILES

FIELD OF THE INVENTION

The present invention relates to a method of and apparatus for rolling. More particularly this invention concerns the hot-rolling of a continuously cast profile.

BACKGROUND OF THE INVENTION

A profile emerging from a continuous-casting machine is normally cut into workpieces that are either rolled immediately, while still hot, or reheated and then rolled. The rolling equipment typically includes at least one universal mill having a vertically spaced pair of rollers rotatable about horizontal axes and a horizontally spaced pair of rollers rotatable about vertical axes. As a rule such roll trains are used reversing style, that is passing the workpiece in one direction through the stands, then back through in the opposite direction.

As is known (See SMS Schloemann-Siemag AG, Dusseldorf publication W No. 2/3115) the input end of a rolling train for rolling out continuously cast workpieces of this type has a heavy duty intake stage which is separated by a considerable distance from the following roll stands which are in turn spaced quite a bit upstream of the output-end finishing roll stands. Similarly German patent document No. 3,627,729 suggests doing away with one of these roll stands when the second or last of the universal stands of the reversing tandem group is set up as a finishing stand. By using a large number of passes through the rolling train it is possible to eliminate other stands provided the workpieces are a continuously cast strand and not a massive billet or bloom.

In such systems it has been found advantageous to use so-called dogbone-section workpieces (See pp 904 and 905 of *The Making, Shaping, and Treating of Steel* [1987; the Association of Iron and Steel Engineers]) as the starting profile workpiece. Such a workpiece section, which is what is used according to this invention, has been found to greatly facilitate the production of profiled finished products, in particular I-beams.

Thus starting with a dogbone-section workpiece it is possible using a reversing tandem roll train to produce I-beams, and using standard two-roll units channels or U-sections can be produced. Since, however, a change in profile demands the use of a new mold and substantial changeover time, it is necessary to shut down between runs of similar but differently dimensioned workpieces.

OBJECTS OF THE INVENTION

It is therefore an object of the present invention to provide an improved method of and apparatus for rolling steel.

Another object is the provision of such a method of and apparatus for rolling steel which overcomes the above-given disadvantages, that is which can produce profile steel members of different sections without changing equipment or starting workpiece shape.

SUMMARY OF THE INVENTION

A hot profile-steel workpiece having a flange width dimension, a web height dimension, and a web thickness dimension is rolled in a roll train including a reversible universal rolling stand and a flange-compacting roll stand upstream therefrom. According to the invention one of the height, width, or thickness dimensions of the incoming workpiece is reduced upstream of the flange-engaging compacting roll stand. Normally the web height dimension is reduced in a roll stand immediately upstream of the universal and flange-compacting stands. Furthermore the workpiece has a web with extra-thick parts and these extra-thick parts are rolled out by horizontal rolls of a roll stand that engage this web. The flange-compacting roll stand engages the faces of the flanges.

With this system it is possible to make the web of the incoming workpiece either shorter or taller, that is it can either be compacted or rolled out. In particular when the web has the above-mentioned extra-thick portions it is particularly easy to roll these out and increase web height. As a result virtually any I-beam shape in the normal range can be produced by the system of this invention.

The apparatus of this invention comprises upstream and downstream compacting roll stands, the upstream one reducing one of the dimensions of the incoming workpiece which is recieved directly from the continuous casting. These are interleaved with upstream and downstream universal roll stands, with the upstream roll stand between the upstream and compacting roll stands. Normally as mentioned the upstream compacting roll stand has rolls bearing horizontally against the workpiece, although it is within the scope of the invention for them to be vertical. It is also possible to provide the upstream compacting roll stand with rolls displaceable between vertical and horizontal positions.

Either of the universal roll stands could be replaced according to this invention with a standard two-roll stand. In addition it is within the scope of this invention to provide a group of finishing roll stands downstream of the compacting and universal stands.

Normally according to this invention the downstream universal roll stand is a finishing stand. Furthermore the upstream roll stand has a pair of V-profile double-frustum rolls engaging the flanges and spreading same. In fact the downstream compacting stand can similarly have a pair of cylindrical rolls engaging the flanges and flattening same and the upstream compacting stand has V-profile double-frustum rollers rotatable about vertical axes.

In accordance with a further feature of this invention the downstream universal roll stand is set for a smaller size reduction than the upstream universal roll stand. In fact the downstream universal roll stand is set for a reduction equal to between 10% and 90% that of the upstream roll stand.

DESCRIPTION OF THE DRAWING

The above and other objects, features, and advantages will become more apparent from the following, reference being made to the accompanying drawing in which.

SPECIFIC DESCRIPTION

Figure 5:
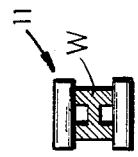
FIGS. 2, 3 4, and 5 are cross sections taken respectively along lines II—II, III—III, IV—IV, and V—V of FIG. 1.

As seen in the drawing a ladle 1 pours molten steel into a tundish 2 feeding a mold 3 having a curved outfeed section 4 feeding the hard but deformable strand S through bending rolls 5 to straightening rolls 6. The strand S is then subdivided longitudinally by a torch or shear 13 into individual blooms or workpieces W. These workpieces W may then be allowed to cool. When left hot as shown in the drawing they are fed directly to a tunnel furnace 8 which ensures that they stay at the optimum working temperature. If left cold the profile workpieces W cut from the strand S are separated from the line and moved by a crane or the like to a cooling station. For rolling, these cooled workpieces W are reheated in the furnace 8 which can be provided with a walking-beam or roller-type conveyor and then fed to the roller conveyor 7 passing through the downstream compact rolling train 14.

This train 14 comprises at its upstream end a vertical-roll compaction stand 9, a universal stand 10 immediately downstream therefrom, a horizontal-roll flange-compressing stand 11, and at the downstream end a second universal stand 12 which serves as finishing stand.

In use the continuously cast workpieces W cut from the strand S by the shear 13 are fed to the train 14 hot, regardless whether they have been cooled and reheated in the furnace 8 or used directly as they come from the continuous casting machine 1–5 with some temperature adjustment in the furnace 8. When rolling standard profiles matched to the equipment the unit 14 is set as if for normal reversing-type operation. At the same time the universal stands 10 and 12 can be used as standard four-roll units, or only two of the rolls of each of these stands 10 and 12 can be employed, the stand 12 always being the finisher so that it reduces workpiece W cross-section less than the stand 10. Thus it is possible with appropriate choice of reductions and of rolling quality to achieve uniform roll life.

Figure 4:
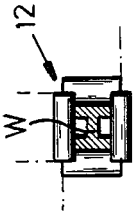
Figure 3:
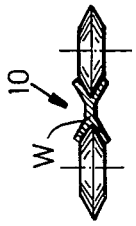
Figure 2:
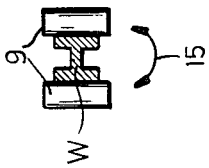
Figure 1:
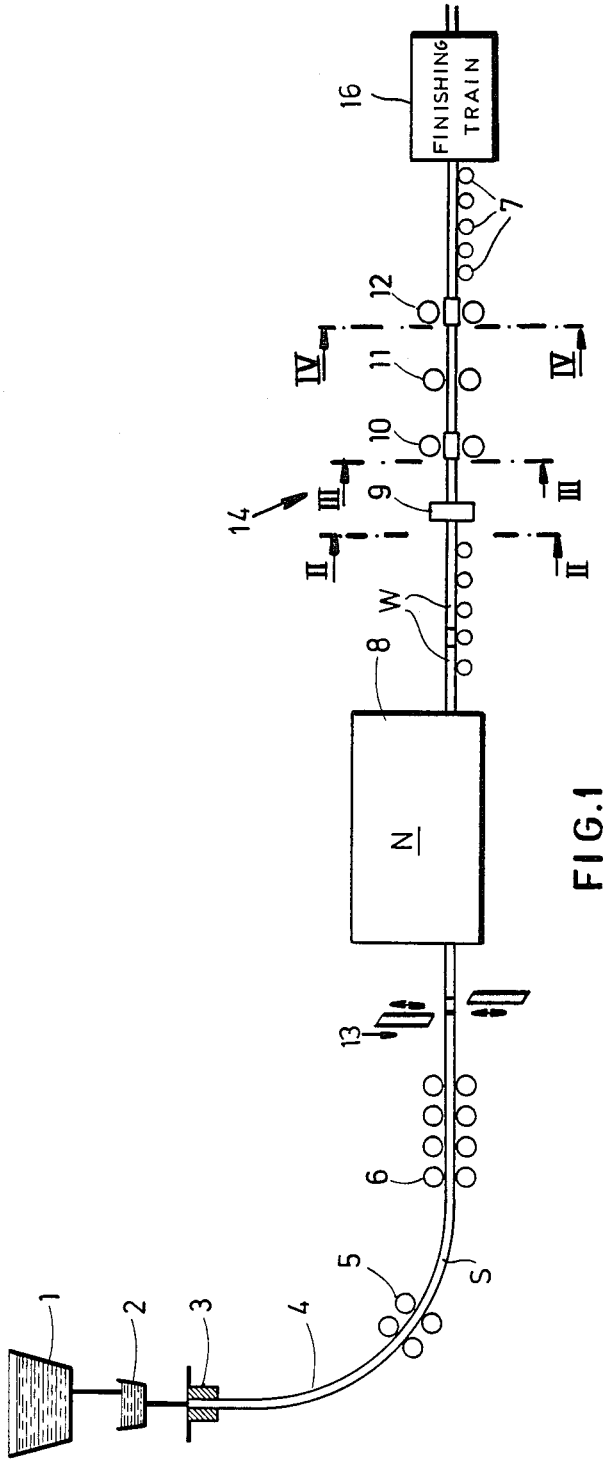
FIG. 1 is a mainly schematic representation of the system of this invention.

This is typically done with a reversing so that three runs produce six passes through the universal stands 10 and 12 and three through the flange-reducing stand 11. The upstream compaction stand 9 is left open on rolling of standard cross workpieces W so as to have no effect on workpiece shape. As is known and as is shown in FIG. 3 the vertical rolls of the universal stand 10 can be shaped as a pair of oppositely directed frustocones centered on the respective rotation axes so that the universal stand 10 bends the flanges of an I-beam over for a so-called x-shaping while as shown in FIG. 4 the vertical rolls of the universal stand 12 are generally cylindrical so that they effect a so-called H-shaping. It is also possible to provide the upstream universal stand 10 with cylindrical rollers so that H-shaping is always used and the flanges lie always in planes perpendicular to the web of the I-beam. In this regard it is noted that as is usual and as shown in FIG. 2 I-sections are being rolled with the edges of the flanges on one side of the profile directed downward and lying on the rolls and their webs horizontal in the vertical middles of the upright flanges.

If the web is relatively short compared to the flanges, the compaction stand 9 with vertical rollers is used and set against the flanges of the starting profile. Pushing together of the flanges of the starting profile compacts and thereby shortens the web. The use of this compaction stand 9 can, in particular when it is used in only one pass, take place simultaneously to shaping in the following stands, so that a continuously cast profile to be rolled is fed to the compaction stand 9 and after compaction of its web to shorten it, the workpiece W is passed immediately to the following universal stand 10, the flange-compacting stand 11, and the universal stand 12. After running completely through and being reversed, the stand 9 is opened enough that on the next forward pass through it does not engage the workpiece W.

For more compaction of the web height it can be necessary to use the stand 9 several times, with reversing action. Thus for the first pass and the first return the rolls of the universal stands 10 and 12 as well as if necessary those of the flange-compaction stand 11 are pulled apart that they do not engage the workpiece W effectively on the first two forward and reverse passes. Only during the third time through the unit 14 are the rolls of the stands 10 and 12 as well as of the stand 11 moved in. During this action regions of the rolls of a further upstream horizontal-roll equipped compaction stand or those of the flange-compaction stand 11 can engage the web of the profile in order to prevent same from being bent out as it is compacted or to realign the horizontal faces of this web.

In order to achieve relatively tall web heights it is also on the other hand possible to switch the compaction stand 9 for one having horizontal rolls. It is also possible to make the frame 9 pivotal about an axis parallel to the travel direction of the workpiece W through 90° as indicated by arrow 15 in FIG. 2 so that it can be used with its rolls either horizontal or vertical. The roll stand 11 would be similarly set up or a further stand with horizontal rolls could be used immediately upstream of the stand 9. In any case calibrating parts set against the edges of the flanges are not used, but instead parts of the rolls are engaged in the region of the web of the profile to be rolled. By heavily rolling out the web of the continuously cast profile it is possible to get a widening of the spacing of the flanges which is equal to an increase in height of the web, typically working with a dogbone-section workpiece W having a web with extra-thick parts. Such extra-thick parts are generally produced in the system without changing the mold by moving its parts or adding parts to it. Such sections lend themselves particularly to a substantial increase of the web height.

In all of these systems the roughing passes, which can number as many as fifteen, are eliminated to spare the roughing stands and an already partly shaped workpiece W is fed to the input of a reversing tandem-type rolling stand without being limited to only some of the possible shapes that can normally be produced. In the case of an upstream vertical-type stand 9 it is possible to reduce web height easily working with vertical rolls of either cylindrical or frustoconical shape in the universal stands. This arrangement also eliminates a further downstream finishing stand or finishing train. It has in fact been found advantages to use as few passes as are used by the upstream roughing-intermediate stand 10. Using a convertible horizontal/vertical upstream stand 9, of the pivotal type shown, greatly increases the control over shape, and it is possible in many instances to use a horizontal-roll upstream roughing stand 9.

We claim:

1. A method of making steel structural shapes, comprising the steps of:

continuously casting an initial steel structural shape having a web and a pair of flanges flanking said web; and rolling said initial structural shape, in the first rolling to which the initial structural shape is subjected, in at least one pass through a compact rolling train of a succession of four mills simultaneously engaging the initial structural shape and subjecting said initial structural shape in said compact rolling train to:

compaction between vertical rolls engaging said flanges to increase the thickness of said web in a first of said mills constituting a vertical-roll compaction stand, rolling of both said web and said flanges in a first universal rolling stand forming a second of said mills immediately downstream of said first of said mills, rolling only of said flanges between horizontal rolls rotatable about vertical axes of a further compaction stand forming a third of said mills immediately downstream of said second of said mills, and rolling of both said web and said flanges in a second universal rolling stand constituted as a finishing universal rolling stand forming the fourth of said mills immediately downstream of said third of said mills.

2. The method defined in claim 1 wherein said structural shape is passed back and fourth through said compact rolling train in a multiplicity of passes following a first pass therethrough and said rolls of said first mill are spread apart following said first pass so as not to engage the structural shape on subsequent passes.

3. The method defined in claim 2 wherein said flanges are indented by horizontal rolls of said second mill.

4. The method defined in claim 1 wherein said flanges are indented by horizontal rolls of second third mill.

* * * * *